US005899787A

United States Patent [19]

Park et al.

[11] Patent Number: 5,899,787

[45] Date of Patent: May 4, 1999

[54] METHOD OF HEATING A BAND FOR A CATHODE RAY TUBE AND AN APPARATUS THEREFOR

[75] Inventors: Neung-seog Park, Kyungsangnam-do; Bong-jin Seoung, Pusan, both of Rep. of Korea

[73] Assignee: Samsung Display Devices Co., Ltd., Kyungki-do, Rep. of Korea

[21] Appl. No.: 08/772,211

[22] Filed: Dec. 20, 1996

[30] Foreign Application Priority Data

Dec. 28, 1995 [KR] Rep. of Korea ..... 95-62151

[51] Int. Cl.[6] ..... H01J 9/00

[52] U.S. Cl. ..... 445/8; 445/66

[58] Field of Search ..... 445/8, 66

[56] References Cited

FOREIGN PATENT DOCUMENTS 1070566 6/1967 United Kingdom .

1103470 2/1968 United Kingdom .

1359368 7/1974 United Kingdom .

*Primary Examiner*—Kenneth J. Ramsey

*Attorney, Agent, or Firm*—Leydig, Voit & Mayer

[57] ABSTRACT

A method for heating an implosion-proof band in a process of banding a cathode ray tube (CRT) and an apparatus for heating the band. The band is thermally expanded before it is attached to the outer surface of a CRT. The method includes generating a first high frequency pulse, generating a second high frequency pulse in response to the first pulse, regulating the level of the second pulse, generating a magnetic field in response to the second pulse, and heating the implosion-proof band by locating the band within the magnetic field. The band is uniformly and completely expanded for easy installation while avoiding deterioration of the surface of the band.

6 Claims, 3 Drawing Sheets

METHOD OF HEATING A BAND FOR A CATHODE RAY TUBE AND AN APPARATUS THEREFOR

BACKGROUND OF THE INVENTION

The present invention relates to a method of heating a band for a cathode ray tube (CRT) and an apparatus therefor, and more particularly, to a method of heating an implosion-proof band in a process of banding the CRT and an apparatus therefor.

The banding process in the fabrication of a CRT involves a process of attaching an implosion-proof band having a predetermined tension on the outer surface of the CRT, thereby preventing an implosion due to cracks in the CRT and improving the effectiveness of the implosion prevention. Generally, a spherical vessel among various vacuum vessels is the most suitable for preventing implosion. However, in the case of the CRT which is not spherical, the banding process is additionally required for preventing implosion. That is, since the outer surface of the CRT has a tensile stress and the inner surface thereof has a compressive stress; the effectiveness of implosion prevention can be increased by the banding process in which a compressive stress corresponding to the tensile stress is applied. In general, a weld banding method is widely used which is comprised of a heating step and a welding step. Here, the heating step is performed to increase tension by thermally expanding the implosion-proof band using an additional heater. The thermally-expanded implosion-proof band is attached to the outer surface of the CRT and then cooled so that the implosion-proof band is shrunk and combined with the outer surface of the CRT.

Conventionally, the implosion-proof band is expanded by heating the implosion-proof band using gas or electricity. Here, the gas heating method is used to heat the implosion-proof band using an apparatus for generating heat, for example, a gas burner. Also, the electricity conduction method is used to apply a low voltage and high current to the implosion-proof band and to heat the band with heat generated by the resistance generated when the implosion-proof band contacts two voltage terminals. However, in the conventional heating method, since heat cannot be consistently and continuously applied to the implosion-proof band due to its characteristics, the following problems are generated. First, since the implosion-proof band does not uniformly expand, the effectiveness of the implosion prevention relatively degrades. Second, since the implosion-proof band does not completely expand, it does not properly insert into the outer wall of the CRT in the next welding step. Third, oxidation of the implosion-proof band is highly probable due to the deterioration of the surface of the implosion-proof band.

SUMMARY OF THE INVENTION

To solve the above problems, it is an object of the present invention to provide a method of heating a band for a cathode ray tube (CRT) which can thermally expand an implosion-proof band uniformly and completely and also prevent the deterioration of the surface of the implosion-proof band.

It is another object of the present invention to provide an apparatus for heating a band for a CRT, which can effectively perform the method.

To accomplish the first object, there is provided, in a method of heating a band for a CRT wherein an implosion-proof band is thermally expanded before it is attached on the outer surface of the CRT, the method comprising the steps of: (S1) generating a predetermined high frequency pulse; (S2) generating a magnetic field using the high frequency pulse; and (S3) forcing the implosion-proof band to generate frictional heat by locating the implosion-proof band within the magnetic field.

It is preferable that the step (S1) is performed by: generating a predetermined first pulse by receiving alternating current from an electric source; generating a second high frequency pulse by receiving the first pulse; and regulating the level of the second pulse. Also, the step (S2) can be performed by applying the high frequency pulse to a parallel circuit in which a high frequency capacitor and a magnetic field generating coil are connected in parallel. At this time, it is preferable that the frequency of the second pulse is a parallel resonance frequency of the high frequency capacitor and the magnetic field generating coil.

Also, to accomplish the second object, there is provided, in an apparatus for heating a band for a CRT wherein an implosion-proof band is thermally expanded before it is attached on the outer surface of the CRT, the apparatus comprising: first means for generating a predetermined high frequency pulse; and second means for generating a magnetic field using the high frequency pulse in order to force the implosion-proof band located at the periphery therof to generate frictional heat.

It is preferable that the first means includes: a first pulse generator for generating a predetermined first pulse by receiving alternating current from an electric source; a second pulse generator for generating a second high frequency pulse by receiving the first pulse; and a pulse level transforming portion for regulating the level of the second pulse. Also, preferably, the second means includes the high frequency capacitor and the magnetic field generating coil which are connected in parallel. At this time, it is preferable that the frequency of the second pulse is a parallel resonance frequency of the high frequency capacitor and the magnetic field generating coil.

BRIEF DESCRIPTION

The above objects and advantages of the present invention will become more apparent by describing in detail a preferred embodiment thereof with reference to the attached drawings in which.

DETAILED DESCRIPTION OF THE INVENTION

A band heating method according to the present invention includes the steps of generating a first pulse from alternating current from an electrical source, generating a second high frequency pulse in response to the first pulse, regulating the level of the second pulse, applying the regulated level second pulse to a parallel circuit including a high frequency capacitor and a magnetic field generating coil connected in parallel, and generating heat in an implosion-proof band with a magnetic field by locating the implosion-proof band at the periphery of the magnetic field generating coil. Here, the magnetic field is generated around the coil by applying the second pulse to the parallel circuit in which the high frequency capacitor and the magnetic field generating coil are connected in parallel. Also, the heat due to the magnetic field is generated in the implosion-proof band by locating the implosion-proof band at the periphery of the magnetic field generating coil. Accordingly, the thermally-expanded implosion-proof band is attached to the outer surface of a cathode ray tube (CRT) and then cooled so that the implosion-proof band is shrunk and combined with the outer surface of the CRT. The use of the heat generated by the high frequency magnetic field effects advantages in that the implosion-proof band is thermally expanded uniformly and completely and the deterioration of the surface of the implosion-proof band is also prevented. The frequency of the high frequency pulse is regulated to a parallel resonance frequency of the high frequency capacitor and the magnetic field generating coil. Thus, a synthetic impedance of the high frequency capacitor and the magnetic field generating coil is increased, and both end voltages are heightened, thereby increasing energy efficiency.

Figure 1:
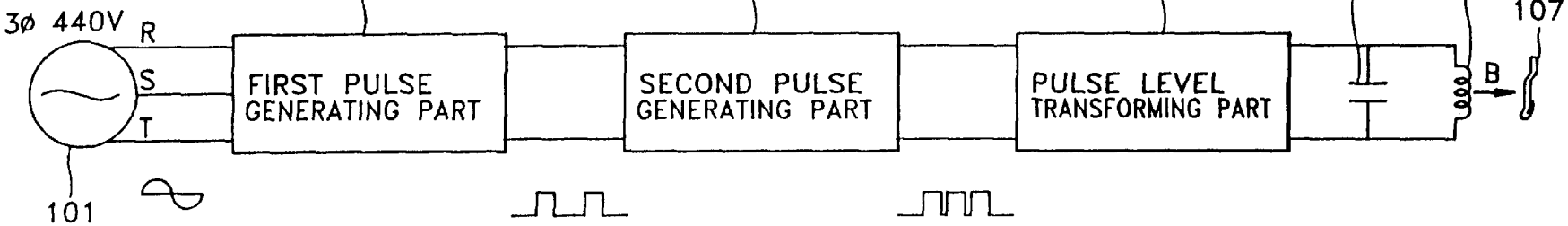
FIG. 1 is a block diagram of a band heating apparatus according to an embodiment of the present invention.

In FIG. 1, a sinusoidal alternating current (AC) generated from an electric source 101 is converted into a pulse signal through a first pulse generator 102. Single-phase and three-phase electric sources can be used as the AC electric source 101. The inner circuits of portions differ according to the electric source used. In the embodiment of the present invention, a three-phase, 440V electric source is employed. The first pulse generator 102 can be comprised of a silicon controlled rectifier (SCR) module and a phase controlling circuit. That is, first pulses equivalent to the frequency of the electric source can be generated by controlling the gate of the SCR module according to the phase of the electric source. The second pulse generator 103 can be comprised of a field effect transistor (FET) module and an FET controlling circuit. That is, second pulses of high frequency can be generated by applying the first pulses to drain and source portions of the FET module and controlling a gate portion thereof by the FET control circuit. The second pulse generator 103 described above can be controlled by a special programmable logic controller PLC. Also, a pulse level transforming portion 104 can be replaced by a transformer of a predetermined standard. A high frequency pulse having a level transformed by the pulse level transforming portion 104 is applied to a high-frequency capacitor 105 and a magnetic field generating coil 106 which are connected in parallel with each other. Thus, a magnetic field B is generated around the coil 106 by the parallel resonance frequency pulse. Also, the frictional heat due to the magnetic field B is generated in the implosion-proof band 107 by locating the implosion-proof band 107 at the periphery of the magnetic field generating coil 106. Accordingly, the thermally-expanded implosion-proof band 107 is attached on the outer surface of the CRT and then cooled so that the implosion-proof band 107 is shrunk and combined with the outer surface of the CRT. The use of the heat generated by the high frequency magnetic field B effects advantages in that the implosion-proof band 107 is thermally expanded uniformly and completely and the deterioration of the surface of the implosion-proof band 107 is also prevented.

Figure 2:
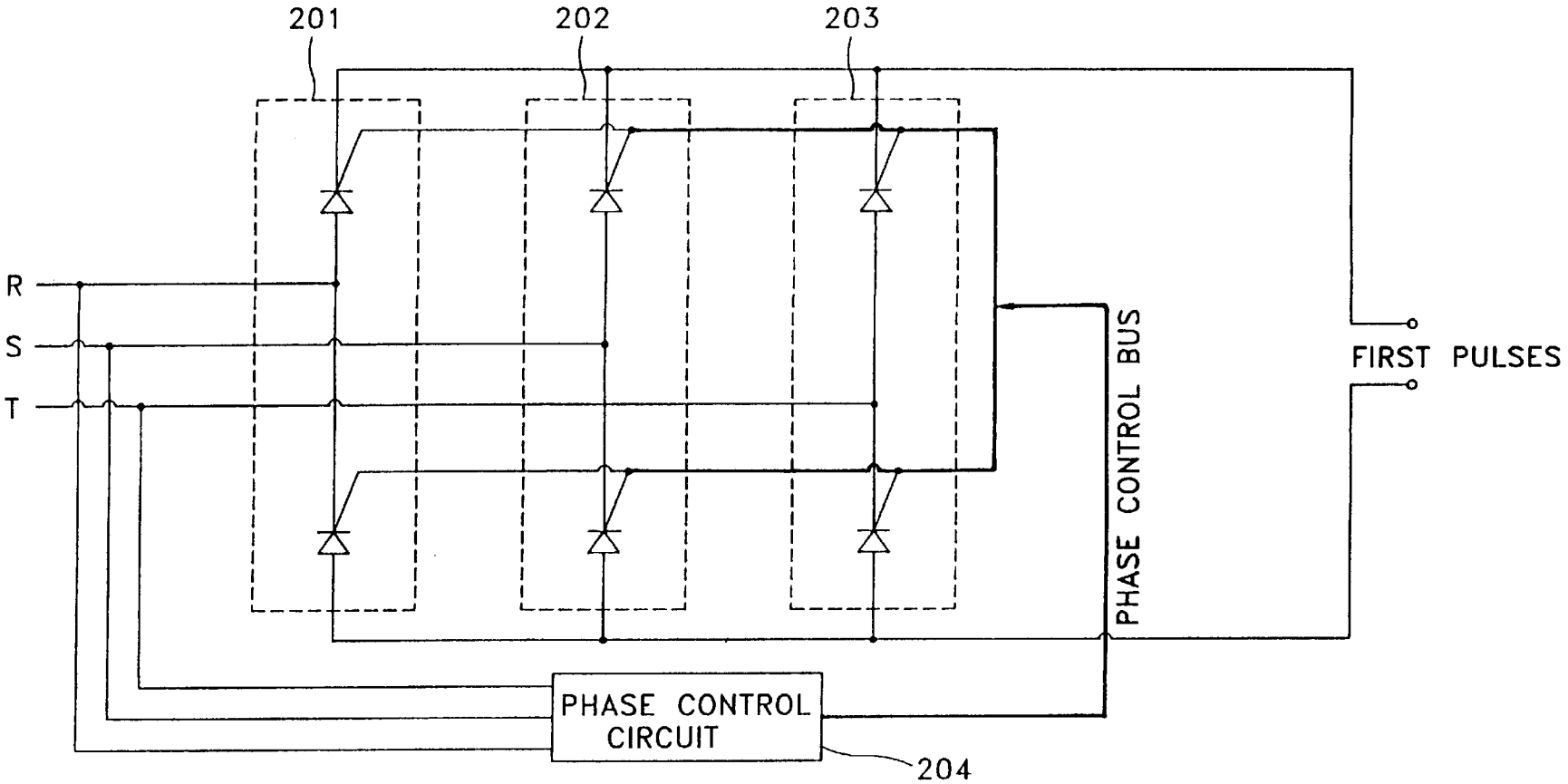
FIG. 2 is an internal circuit diagram of the first pulse generator of FIG. 1.

Referring to FIG. 2, when the three-phase electric source is used, the SCR module of the first pulse generator 102 of FIG. 1 is comprised of three portions 201, 202, and 203 each having first and second SCRs which connect to each other in series. That is, the anode of the first SCR connects with the cathode of the second SCR. Here, R, S, and T terminals connect with the connection point of the first. SCR and the second SCR, respectively. Every gate is controlled by the phase control circuit 204 so that the first pulse can be generated between the cathode of the first SCR and the anode of the second SCR. The three-phase electric source of FIG. 2 is an electric source whose level has been regulated through a predetermined transformer (not shown). The three-phase electric source is applied to the SCR modules 201, 202, and 203 and the phase control circuit 204 at the same time. The phase control circuit 204 applies continuous control signals of each different phase to the corresponding SCR gate through a phase control bus so that the first pulse can be generated in the SCR module. The first pulse generated is input into the second pulse generator 103 as described in FIG. 1.

Figure 3:
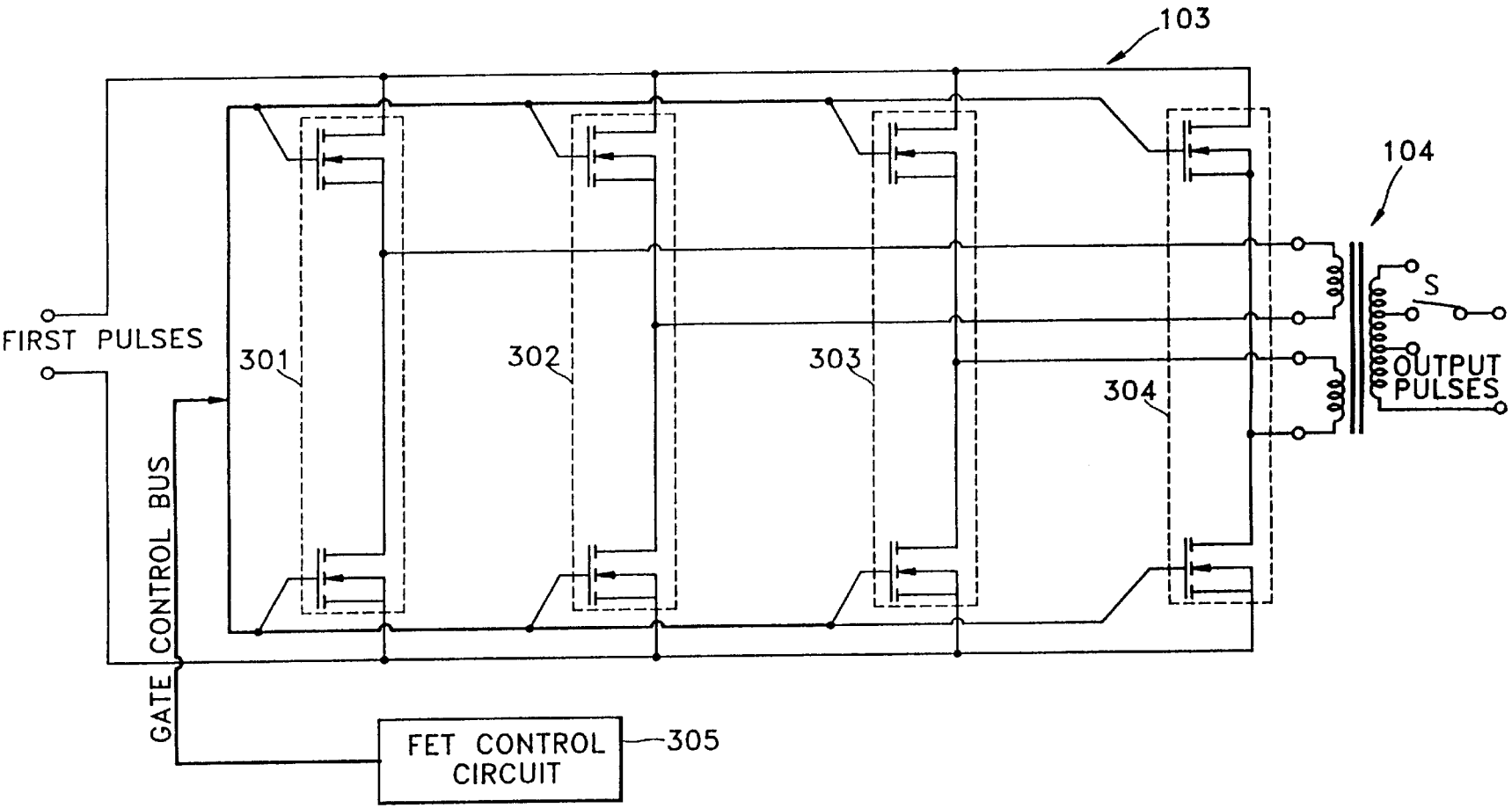
FIG. 3 is an internal circuit diagram of the second pulse generator and the pulse level transforming portion of FIG. 1.

As shown in FIG. 3, the FET module of the second pulse generator 103 of FIG. 1 includes four portions 301, 302, 303 and 304 each having upper and lower FETs which connected to each other in series. That is, the source of the upper FET connects with the drain of the lower FET. The input first pulses are commonly applied between the drain of the upper FET of each FET module 301, 302, 303 and 304 and the source of the lower FET thereof. Gate driving signals of each FET are applied to a gate of each corresponding FET through a gate control bus from an FET control circuit 305. For example, after the upper FET of the first portion 301 is turned on and the lower FET thereof is turned off, and the upper FET of the second portion 302 is turned off and the lower FET thereof is turned on, the states of all the FETs are shifted so that the direction of current flowing in a first-order coil of the pulse level transforming portion 104 can be shifted. Accordingly, the states of the FET modules 301, 302, 303 and 304 are continually shifted by the FET control circuit 305 so that the second pulse is applied to the first-order coil of the pulse level transforming portion 104, and a high frequency output pulse is induced in a second-order coil thereof. The level of the output pulse induced in the second-order coil of the pulse level transforming portion 104 can be regulated by a selection switch S. Here, the FET control circuit 305 can control a state shift period of each gate driving signal in order to make the frequency of the output pulse equal the parallel resonance frequency of the high frequency capacitor 105 of FIG. 1 and the magnetic field generating coil 106 of FIG. 1. The pulse of the parallel resonance frequency causes generation of the magnetic field B of FIG. 1 around the magnetic field generating coil 106. Also, the heat due to the magnetic field B is generated in the thermally-expanded implosion-proof band 107 by locating the implosion-proof band 107 of FIG. 1 around the magnetic field generating coil 106. Then, the thermally-expanded implosion-proof band 107 is attached on the outer surface of the CRT and cooled so that the implosion-proof band 107 is shrunk and combined with the outer surface of the CRT.

The present invention is not limited to the above embodiment, and utilization thereof and improvement thereupon may be effected within the level of those skilled in the art.

As described above, in the method of heating the band for the CRT according to the present invention, the heat due to the high frequency magnetic field is used, thermally expanding the implosion-proof band completely and uniformly and preventing the deterioration of the surface thereof as well. Furthermore, the apparatus for heating a band for the CRT according to the present invention can effectively perform the method.

What is claimed is:

1. A method of heating an implosion-proof band for a cathode ray tube (CRT) for thermal expansion before attachment to an outer surface of the CRT, the method comprising:

generating a high frequency pulse by generating a first Pulse in response to alternating current from an electrical source, generating a second pulse in response to the first pulse, and regulating the level of the second pulse;

generating a magnetic field using the second pulse; and heating an implosion-proof band by locating the implosion-proof band within the magnetic field.

2. The method of heating an implosion-proof band for a CRT as claimed in claim 1, including generating a magnetic field by applying the second pulse to a parallel circuit of a high frequency capacitor and a magnetic field generating coil.

3. The method of heating an implosion-proof band for a CRT as claimed in claim 2, wherein the second pulse has a frequency equal to a parallel resonance frequency of the high frequency capacitor and the magnetic field generating coil.

4. An apparatus for heating an implosion-proof band for a cathode ray tube (CRT) for thermal expansion before attachment to an outer surface of the CRT, the apparatus comprising:

first pulse generating means for generating a first pulse in response to alternating current received from an electrical source;

second pulse generating means for generating a second pulse in response to the first pulse;

pulse level transforming means for regulating the second pulse; and means for generating a magnetic field in response to the second pulse thereby generating heat in an implosion-proof band located at a periphery of said means for generating a magnetic field.

5. The apparatus for heating an implosion-proof band for a CRT as claimed in claim 4, wherein said means for generating a magnetic field comprises a high frequency capacitor and a magnetic field generating coil connected in parallel.

6. The apparatus for heating an implosion-proof band for a CRT as claimed in claim 5, wherein said second pulse generating means generates a second pulse having a frequency equal to a parallel resonance frequency of said high frequency capacitor and said magnetic field generating coil.

* * * * *